United States Patent [19]

Bauder et al.

[11] 4,446,828

[45] May 8, 1984

[54] RECIPROCATING INTERNAL COMBUSTION ENGINE

[75] Inventors: Armin Bauder; Gerd Ohrnberger, both of Neckarsulm, Fed. Rep. of Germany

[73] Assignee: Audi Nsu Auto Union Aktiengesellschaft, Fed. Rep. of Germany

[21] Appl. No.: 444,481

[22] Filed: Nov. 24, 1982

[30] Foreign Application Priority Data

Nov. 26, 1981 [DE] Fed. Rep. of Germany ..... 3146799

[51] Int. Cl.[3] ..... F01M 1/00

[52] U.S. Cl. ..... 123/196 R; 123/195 R; 123/195 C; 123/195 HC; 184/6.5

[58] Field of Search ..... 123/195 R, 195 S, 195 HC, 123/195 C, 195 AC, 196 R; 184/6.5, 6.6, 6.7, 6.8, 6.9

[56] References Cited

U.S. PATENT DOCUMENTS

| | | | |
|---|---|---|---|
| 2,118,283 | 5/1938 | Winslow | 184/6.8 |
| 3,421,490 | 1/1969 | Wiseman | 123/196 R |
| 3,983,852 | 10/1976 | Chatourel | 123/195 C |

FOREIGN PATENT DOCUMENTS

| | | | |
|---|---|---|---|
| 2849613 | 5/1979 | Fed. Rep. of Germany | 123/195 C |
| 2834089 | 2/1980 | Fed. Rep. of Germany | 123/195 C |
| 2065225 | 6/1981 | United Kingdom | 123/195 C |

*Primary Examiner*—Charles J. Myhre
*Assistant Examiner*—E. Rollins Cross
*Attorney, Agent, or Firm*—Kane, Dalsimer, Kane, Sullivan and Kurucz

[57] ABSTRACT

In a reciprocating piston internal combustion engine to be installed horizontally in a motor vehicle the cylinder block (2), the cylinder head (4), one half (8) of the crankcase and the oil sump (9) are formed from a single casting, the oil sump being positioned below the cylinder block and having an opening (13) in the same plane as a flat surface (12) on the cylinder head which locates a camshaft case (14).

The camshaft case (14) and the oil sump cover (17) are formed as one unit, and a stay between the camshaft case and the oil sump cover accommodates the drive shaft (21) of an oil pump (22) located in the oil sump and driven by the camshaft. A second stay (19) between the camshaft case and the oil sump cover contains a duct (25) for conveying oil from the camshaft case back into the oil sump.

5 Claims, 2 Drawing Figures

RECIPROCATING INTERNAL COMBUSTION ENGINE

This invention relates to a reciprocating piston engine of the type having a casting which surrounds the cylinder head, the cylinder block, and part of the crankcase. An engine of this type has been disclosed in German Patent No. 25 01 605.

The object of the present invention is to provide an improved engine of this general type, which will be simpler to manufacture and assemble.

Broadly stated the invention consists in a reciprocating piston internal combustion engine having a casting which encloses the cylinder head, the cylinder block, and part of the crankcase and also forms part of the oil sump, and in which the oil sump has an opening lying in the same plane as a surface of the cylinder head which locates a camshaft case, the camshaft case together with a cover which closes the opening of the oil sump being formed as a single casting.

Because the casting which encloses the cylinder head, the cylinder block and part of the crankcase, also encloses the oil sump, the number of engine components can be reduced and the manufacture operations simpler and less expensive. The positioning of the opening of the oil sump in a common plane with that surface of the cylinder head which locates the camshaft case makes it possible to machine the support surfaces for the camshaft case and the oil sump cover in one operation. The combination of the camshaft case and the oil sump into a single casting also simplifies assembly of the engine. It is especially advantageous to provide between the camshaft case and the oil sump cover a stay which houses a drive shaft for an oil pump located in the oil sump and driven by the camshaft. As a result it is possible to pre-assemble the camshaft and the oil pump as a unitary component which can be simply bolted onto the casting.

Preferably there is also a second stay which runs between the camshaft case and the oil sump cover, and provides a lubricating oil duct for feeding lubricating oil to or from the camshaft case. This results in a particularly neat and simple method of supplying oil to the camshaft, and to hydraulic tappets if used.

The engine according to the invention is primarily intended to be installed horizontally in a motor vehicle. This results in a particularly space-saving assembly, which enables the drive shaft to be positioned behind the oil sump, in the case of vehicle transmissions in which the engine is bolted to the gearbox and the differential gear.

Figure 1:
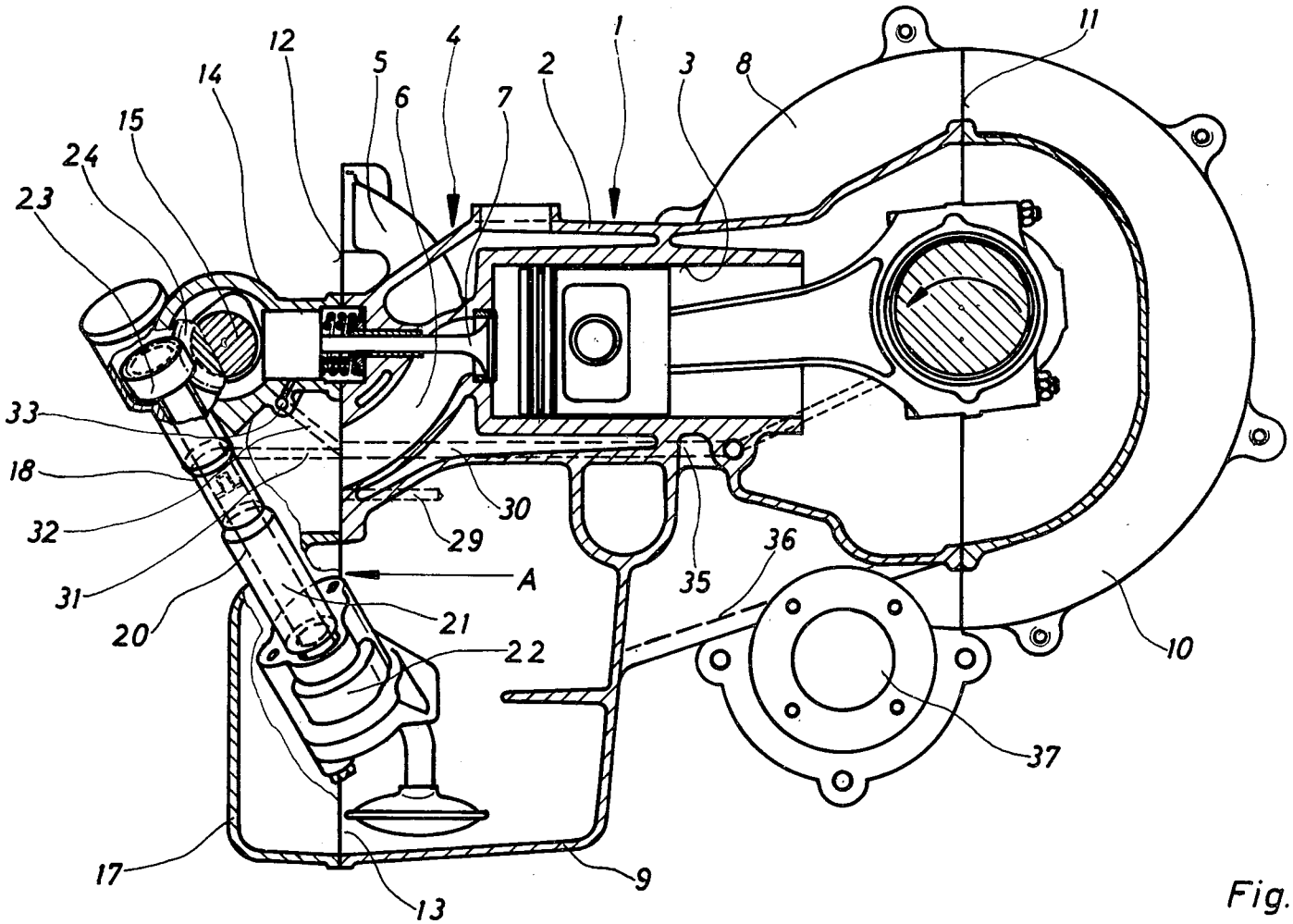
Figure 2:
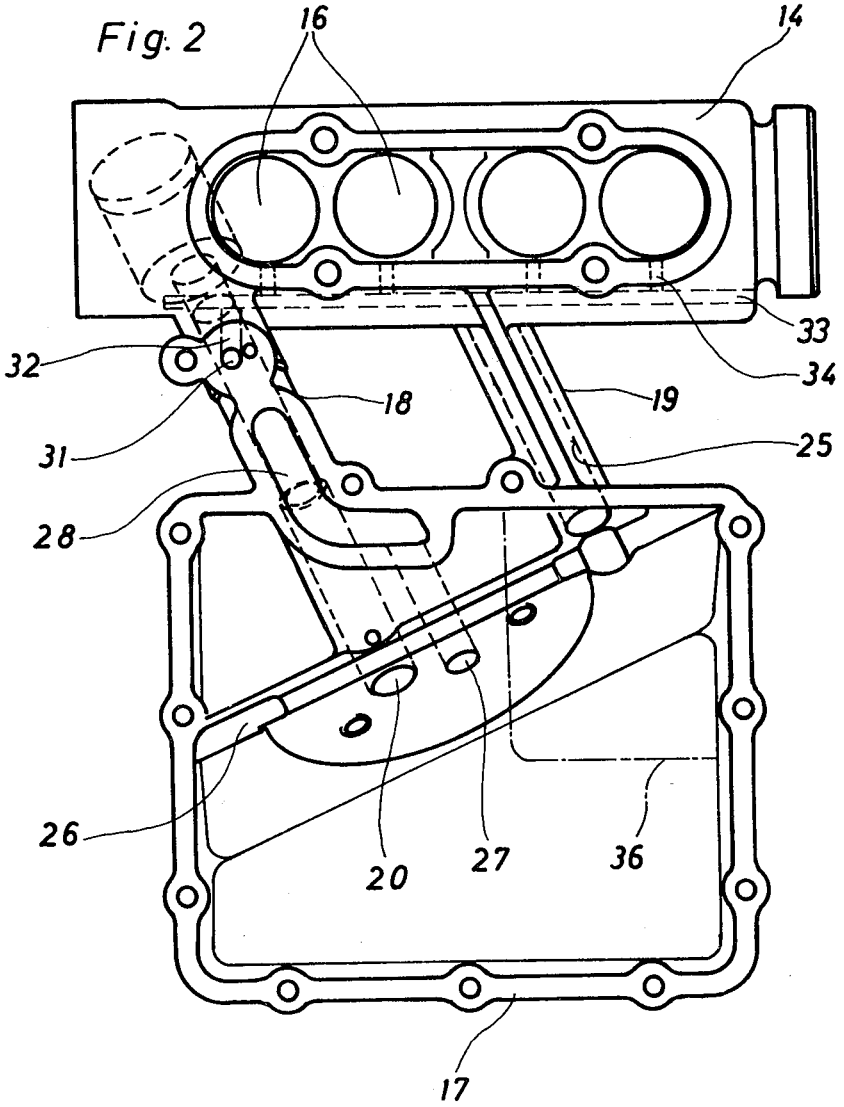

The invention may be performed in various different ways and one specific embodiment will now be described by way of example with reference to the accompanying drawings, in which:

FIG. 1 is a longitudinal section through an engine according to the invention, and FIG. 2 is a top plan view of the casting forming the camshaft case and the oil sump cover, as seen in the direction of the arrow A in FIG. 1.

The engine illustrated in longitudinal section in FIG. 1 includes a casting which is indicated generally at 1 and encloses the cylinder block 2 with the cylinder bores 3, the cylinder head 4 with the inlet passages 5 and exhaust passages 6 and also the inlet valves (not shown) and the outlet valves 7, one half 8 of the crankcase, and the oil sump 9. The other half 10 of the crankcase is flange-mounted on the above mentioned half 8. On the cylinder head end of the casting 1, is provided a flat surface which lies parallel with the crankcase flange surface 11 and extends not only across the cylinder head 4, but also across the oil sump 9 and has an opening 13 for the oil sump 9. A camshaft case 14 is flange-mounted on the flat surface 12, the case 14 being designed as a tunnel case, into which the camshaft 15 is inserted and in which it is mounted at both ends. The camshaft case 14 also has circular cavities 16 (see FIG. 2) for receiving hydraulic tappets for the inlet and outlet valves. A cover 17, which closes the opening 13 of the oil sump 9, is made in one component with the camshaft case 14, the oil sump cover 17 being joined to the camshaft case 14 by two stays 18 and 19. The stay 18 has a longitudinal bore 20 for accepting the drive shaft 21 of an oil pump 22 located in the oil sump 9, and at the top end of the drive shaft 21 is mounted a pinion 23, which engages with a toothed gear 24 attached to the camshaft 15. In the second stay 19 there is a bore 25 for conveying oil from the camshaft case 14 back into the oil sump 9. The oil pump 22 is bolted onto a flange 26 in the oil sump cover 17 and conveys oil from the oil sump 9 through a bore 27 into an open duct 28, which communicates with a bore 29 in the cylinder head 4 leading to an oil filter (not shown). From this oil filter the oil passes via a bore 30 in the cylinder head 4 through a bore 31 in the camshaft case 14 to the bore 20 which accommodates the drive shaft 21 of the oil pump 22, and through a slanting passage 32 to a bore 33 which passes through the camshaft case 14 in the longitudinal direction, and from which passages 34 branch off to the camshaft bearings and to the tappets in the cavities 16. The filtered lubricating oil passes through a duct 35 in the cylinder block 2 to the crankshaft bearings and to the crankshaft. The oil which collects in the crankcase can flow back into the oil sump 9 through a duct 36 in the casting 1, shown in chain lines in FIG. 2.

The engine as illustrated is intended to be installed horizontally in a motor vehicle. Here, the oil sump, as can be seen, is situated below the cylinders 3, so that space remains underneath the crankcase 8 and 10 for a drive shaft 37 (indicated diagrammatically), to be led through.

The entire engine housing, as can be seen, is essentially composed of only three parts, firstly the casting 1 (which comprises the cylinder block 2, the cylinder head 4, one half 8 of the crankcase and the oil sump 9), secondly the second half 10 of the crankcase 10, and thirdly the casting forming the camshaft case 14 and the oil sump cover 17. The casting 1 may be formed of light alloy or cast iron, and the machining of the two surfaces 11 and 12 can be carried out in one operation. Because the camshaft case 14 with the oil sump cover 17 constitute a single part, the camshaft 15 can be pre-assembled complete, together with the oil pump 22. By bolting this unit to the flat surface 12 of the cylinder head 4, all the connections which are necessary for feeding oil from the oil sump into the camshaft case and for conveying oil from the camshaft case back into the oil sump 9 are provided in one operation.

We claim:

1. A reciprocating piston internal combustion engine, including a cylinder head, a cylinder block providing the cylinder bores, a crankcase, an oil sump, and a camshaft case, and including a main casting which constitutes said cylinder head and cylinder block and also forms part of said crankcase and part of said oil sump, and including a second casting which forms said camshaft case together with a cover for said oil sump, and in which said cylinder head is formed with a locating surface for said camshaft case, and said oil sump has an opening for said oil sump cover lying in the same plane as the locating surface on said cylinder head.

2. A reciprocating engine according to claim 1, in which said second casting includes a stay which interconnects said camshaft case with said oil sump cover, and including an oil pump located in said oil sump and a drive shaft connecting said oil pump to a camshaft of the engine, said drive shaft being housed within said stay.

3. A reciprocating piston engine according to claim 2, in which said second casting includes a second stay providing a lubricating duct for feeding oil between said oil sump and said camshaft case.

4. A reciprocating piston engine according to claim 1, in which said main casting includes a duct extending upwards at an incline between said oil sump and said crankcase.

5. A reciprocating piston engine according to claim 1, installed with said cylinder bores horizontal, and in which said oil sump is located below the cylinders in said cylinder block.

* * * * *